US007022951B2

(12) United States Patent
Larivé et al.

(10) Patent No.: US 7,022,951 B2
(45) Date of Patent: Apr. 4, 2006

(54) INDUCTION HEATING WORK COIL

(75) Inventors: René Larivé, Grand-Mere (CA); Sylvain Larivé, Grand-Mere (CA)

(73) Assignee: Comaintel, Inc., Quebec (CA)

( * ) Notice: Subject to any disclaimer, the term of this patent is extended or adjusted under 35 U.S.C. 154(b) by 53 days.

(21) Appl. No.: 10/298,420

(22) Filed: Nov. 18, 2002

(65) Prior Publication Data

US 2004/0094538 A1 May 20, 2004

(51) Int. Cl.
*H05B 6/14* (2006.01)

(52) U.S. Cl. ..... 219/619; 219/622; 219/642; 219/624; 219/670

(58) Field of Classification Search ..... 219/619, 219/624, 630, 644, 673, 633, 670, 622, 642; 399/328

See application file for complete search history.

(56) References Cited

U.S. PATENT DOCUMENTS 3,187,155 A * 6/1965 Beckert et al. ..... 219/642
4,384,514 A 5/1983 Larivé et al.
4,704,509 A * 11/1987 Hilmersson et al. ..... 219/633
4,788,779 A 12/1988 Sparkes
5,101,086 A 3/1992 Dion et al.
5,350,901 A * 9/1994 Iguchi et al. ..... 219/630
5,523,546 A * 6/1996 Lake ..... 219/644
5,552,582 A * 9/1996 Abe et al. ..... 219/619
6,087,641 A * 7/2000 Kinouchi et al. ..... 219/619
6,097,926 A * 8/2000 Takagi et al. ..... 399/328
6,232,586 B1 * 5/2001 Eskildsen ..... 219/622

* cited by examiner

*Primary Examiner*—Robin O. Evans
*Assistant Examiner*—Leonid M. Fastovsky
(74) *Attorney, Agent, or Firm*—Michael M. Rickin, Esq.; Paul R. Katterle

(57) ABSTRACT

An induction heating device or work coil for heating electroconductive material to a desired temperature that can be used on a roll or cylinder of any diameter. The work coil has an open core of ferrite material shaped in a U. Wire is wound around the opposing legs of the U so that on excitation one leg becomes the N pole and the other leg becomes the S pole and the polarity alternates as the polarity of the excitation current alternates. A substantially thin rectangular flat layer of ferrite can be attached to ends of each pole piece. Each layer of ferrite has having a length sufficient to cover bottom end of each leg and a width in the direction of an axis perpendicular to the face of the U that corresponds to the width of the desired control heating effect.

27 Claims, 2 Drawing Sheets

INDUCTION HEATING WORK COIL

FIELD OF THE INVENTION

This invention relates to induction heating devices or work coils for heating electroconductive material to a desired temperature and more particularly to such a coil that can be used on a roll or cylinder of any diameter.

DESCRIPTION OF THE PRIOR ART

Papermaking and many other industrial processes presently use or would benefit from using induction heating to raise the surface temperature or to control the local diameter of steel and cast iron rolls. Examples of these industrial processes include (1) methods for controlling a nip and a desired physical property of a product involving a web material subjected to a roll pressing operation; (2) methods for heating a rotating roll surface uniformly; (3) methods for pressing and drying a web on rotating metal cylinders; (4) methods of calendering web material; (5) laminating and (6) operations such as: glazing; soldering; bonding or welding; hot metal pressing, extruding, etc. The typical induction profiler workcoil used in roll heating and nip pressure profile control applications requires a shape conforming to the arc of the roll being affected by magnetic induction in order to efficiently transfer energy from the workcoil into the roll.

Roll diameters used in manufacturing processes vary largely because of the many different manufacturers providing machinery. For example, paper machine calenders use rolls of different diameters depending on machine width and speed and equipment configurations. Roll diameters vary also as a result of maintenance grinding for roll resurfacing, or diameter expansion as result of roll temperature increase. Once an induction profiler has been installed on the equipment being heated, changes in roll diameters invariably result in a decrease in induction profiler total efficiency or in cases where the processes requires changes to a roll of different diameter, the replacement of the workcoil for one matching the new roll diameter.

Various embodiments have been disclosed in the prior art for workcoils. One such prior art workcoil is described in U.S. Pat. No. 4,384,514 ("the '514 patent") which issued on May 24, 1983, the disclosure of which is hereby incorporated herein by reference. The coil described therein is a flat or pancake coil as shown in FIG. 3 of the '514 patent.

To efficiently transfer sufficient energy from the flat coil to the surface of the roll it was found that the coil had to be fairly large and the shape of the coil had to conform to the arc of the roll. This is illustrated in FIGS. 1 and 3 and described in col. 4, lines 34–43 in the '514 patent. Roll and cylinder diameters vary over a very wide range, requiring a similar wide range of work coils, increasing their unit and inventory costs.

As a result of maintenance grinding for roll resurfacing as well as expansion during heating, the diameter of a given roll changes and this affects the operation and efficiency of the flat work coil being used to heat the roll. There was also a demand in the various industries for higher surface temperatures and flat coils were reaching their limit. Further flat coils were not that efficient. Since the flat coil was fairly large, it was difficult to use in some locations.

Industry also kept demanding a finer and more uniform control of the various process variables involved in the manufacturing of the various products. The finest control width of the flat coil was approximately 70 mm.

U.S. Pat. No. 5,101,086 ("the '086 patent") discloses a work coil which attempts to meet the demand for higher temperatures. The coil described in the '086 patent has an open E shaped core with one coil of wire on the middle leg of the E. It is known that the coil described in the '086 patent can only reach an output of 4 kW without cooling.

The shape of the coil of the '086 patent as is illustrated in FIG. 1 still must conform to the arc of the roll. Thus the coil of the '086 patent has the problems discussed above for flat coils.

SUMMARY OF THE INVENTION

An induction heating device for heating electroconductive material to a desired temperature. The device has an open core of magnetic material shaped in a U. The device also has a coil of electrically conductive material wound separately on each leg of the U, the coils for simultaneously receiving in a parallel a current to excite each of the coils, each of the legs becoming the pole pieces of a magnetic flux concentrator whenever the excitation current is passed through the coils in parallel to produce a variable magnetic field of very high flux density in the space between the two edges, facing each other, at the ends of the two poles, and closest to the material being heated. In the device each of the coils are wound around each leg in a direction such that on excitation, when one leg becomes the N pole of the flux concentrator the other leg becomes the S pole of the concentrator, the legs alternating in polarity when the excitation current alternates in polarity, thereby forcing the magnetic flux to pass between the edges at the ends of the pole pieces, facing each other, and through the material to be heated.

An induction heating device for heating electroconductive material to a desired temperature. The device has an open core of magnetic material shaped in a U. The device also has a coil of electrically conductive material wound separately on each leg of the U, each leg ending in a shape not conforming to an exterior shape of an apparatus to be heated by the induction heating device, each of the legs becoming the pole pieces of a magnetic flux concentrator whenever an excitation current is passed through the two coils in parallel to produce a variable magnetic field of very high flux density in the space between the two edges, facing each other, at the ends of the two poles, and closest to the material being heated. In the device each of the coils are wound around each leg in a direction such that on excitation, when one leg becomes the N pole of the flux concentrator the other leg becomes the S pole of the concentrator, the legs alternating in polarity when the excitation current alternates in polarity, thereby forcing the magnetic flux to pass between the edges at the ends of the pole pieces, facing each other, and through the material to be heated.

An induction heating device for heating electroconductive material to a desired temperature. The device has an open core of magnetic material shaped in a U. The device also has a coil of electrically conductive material wound separately on each leg of the U, each of the legs becoming the pole pieces of a magnetic flux concentrator whenever an excitation current is passed through the two coils in parallel to produce a variable magnetic field of very high flux density in the space between the two edges, facing each other, at the ends of the two poles, and closest to the material being heated thereby allowing the induction heating device to accommodate a change in diameter of an apparatus to be heated by the induction heating device without a change in the core and the coils. In the device each of the coils are wound around each leg in a direction such that on excitation, when one leg becomes the N pole of the flux concentrator the other leg becomes the S pole of the concentrator, the legs alternating in polarity when the excitation current alternates in polarity, thereby forcing the magnetic flux to pass between the edges at the ends of the pole pieces, facing each other, and through the material to be heated.

DESCRIPTION OF THE PREFERRED EMBODIMENT(S)

Figures 1, 1A:
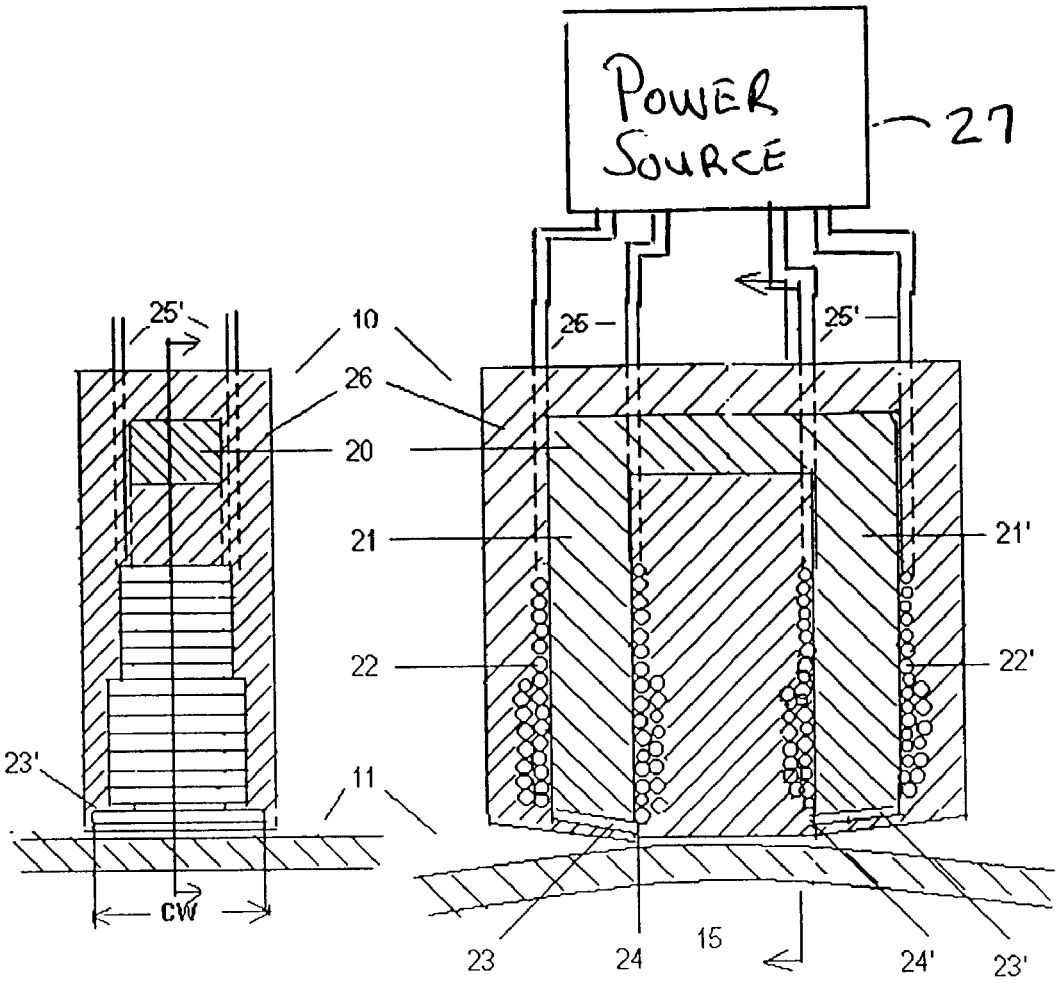
FIG. 1 is a cross-sectional view of a work coil constructed according to the present invention, illustrating the position of the coils and the sloping profile of the pole ends, with ferrite layers attached.
FIG. 1A is a cross-sectional view of the end of a work coil of FIG. 1, showing the control width (CW) of the thin layer of ferrite attached to end of each pole piece.

Referring now to FIG. 1 there is shown a cross-sectional view of an induction heating device or work coil 10 embodied in accordance with the present invention. Work coil 10 is closely spaced to the surface 11 of a roll 15 whose ferromagnetic surface, is to be heated by the work coil. The work coil comprises an open core 20 of ferrite material shaped in a U defining opposed legs 21 and 21' about each of which a coil 22 and 22' of Litz wire is wound. As is shown in FIG. 1, the wire is wound partially single and double layered around each leg. Thus the legs 21 and 21' now become the pole pieces 21 and 21' of a magnetic flux concentrator whenever an excitation current is passed through the two coils 22 and 22' (in parallel) to produce a variable magnetic field.

How and where the coil 22 and 22' is wound around each leg 21 and 21' is very important for maximum efficiency of the work coil of the present invention. In winding each coil 22 and 22' around each leg 21 and 21', the direction of winding should be such that on excitation, when one leg becomes the N pole the other leg becomes the S pole and this polarity alternates each time the current alternates thereby forcing the magnetic flux to pass between the facing edges 24 and 24' at the ends of the pole pieces 21 and 21' and through the surface to be heated. This alternating polarity can be accomplished by winding the coil on one leg in a clockwise direction and on the other leg in a counter-clockwise direction. When a minimum of windings and multiple layers are used they should be located as close to the ends of the legs 21 and 21' as possible as is shown in FIGS. 1 & 1A.

While the open core 20 can be made of any material having a high magnetic permeability, it has been found that ferrite is quite satisfactory for most applications. The ferrite core normally used is U 93/76/30 type 3C90, which has a very high magnetic permeability. While Litz wire is preferred for coils 22 and 22', other types of wire can be used. The size of wire, the number of turns and the number of layers (normally no more than two) used, depend on the power being generated.

Figure 3A:
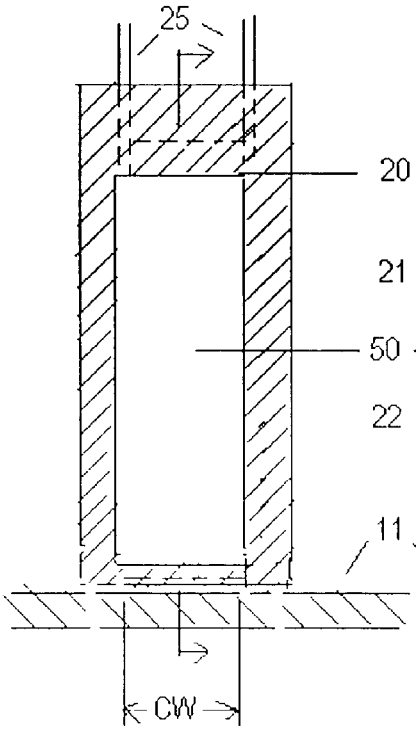
FIG. 3A is a cross-sectional view of the end of the work coil of FIG. 3, showing the side layer of ferrite and the control width (CW) when no extra layer of ferrite is attached to the end of each pole piece.

The width of the magnetic material at each end of each pole piece 21 and 21' determines the width of the magnetic field between the edges 24 and 24' which becomes the control heating width CW. This width can be quite restrictive as is shown in FIG. 3A for one size of core 20.

This restriction in width for one size of core can be overcome by attaching as is shown in FIG. 1 to each of the ends of the poles 21 and 21' a separate substantially rectangular flat thin layer of ferrite 23 and 23'. Ferrite layers 23 and 23' each have a length sufficient to cover the bottom end of each leg, but a width CW in the direction of an axis perpendicular to the face of the U that corresponds to the width of the desired control heating effect. As can be seen from a comparison of the control width CW in the embodiment of FIG. 1A with the width CW shown in FIG. 3A the ferrite layers 23 and 23' allow a fairly wide range of control widths to be selected.

The edges 24 and 24' of layers 23 and 23' initiate a variable magnetic field of very high flux density in the space between the edges 24 and 24', facing each other, whenever an excitation current is passed through the two coils 22 and 22'. Because the field is concentrated between the two edges 24 and 24, with a small space between them, the field can easily be brought very close to the surface being heated, which in turn increases the efficiency of the work coil.

Each of the coils 22 and 22' has terminal wires 25 and 25' to which a power source 27 is attached.

Figure 3:
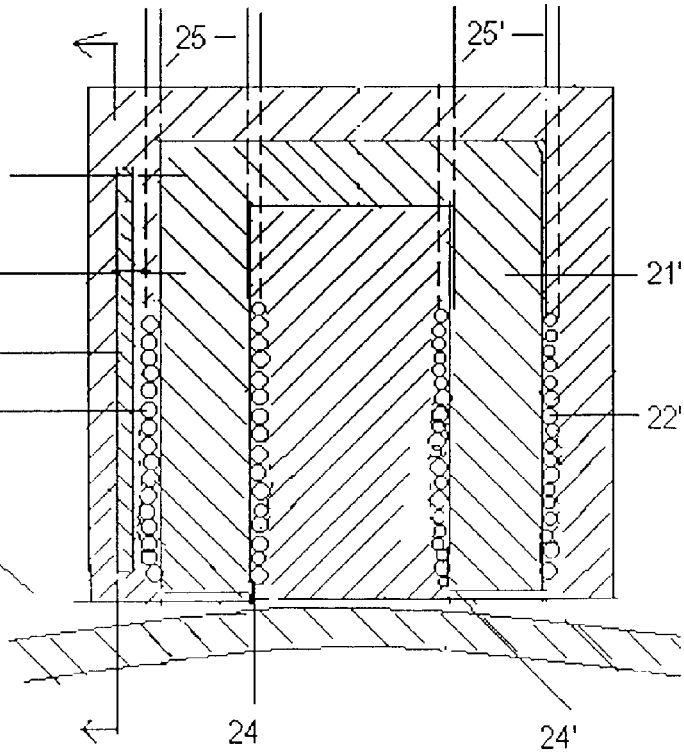
FIG. 3 is a cross-sectional view of another embodiment for the work coil of the present invention, showing the thin layer of ferrite attached on one of the sides of the work coil.

By varying the profile of the position of the layers of coils 22 and 22', a more pointed profile, such as the profile shown in FIGS. 1 and 1A, can place the magnetic field closer to the surface being heated than the placing of the magnetic field arising from the flat profile shown in FIGS. 3 and 3A. This closet placement of the magnetic field in the embodiment of FIGS. 1 and 1A further increases the efficiency of the work coil 10, and its ability to cope with very irregular surfaces e.g. convex. For optimum efficiency, the distance between edges 24 and 24' should be only larger enough to ensure that the flux lines pass through the surface to be heated, rather than straight across.

The U core 20 can generate up to 6–7 kW before beginning to become saturated. Its CW (see FIG. 3A) is 30 mm in comparison to the 70 mm CW for the flat coil described in the '514 patent. The CW of U core 20 can be increased to 70 mm or more using the ferrite layer 23 and 23' shown in FIGS. 1 & 1A. For more power up to 25 kW or more (and higher temperatures and a wider CW) and to avoid ordering special cores, additional U cores like U core 20 can be stacked together face to face, creating thicker legs around which Litz wire can be wound and to which ferrite layers can be attached as described above.

Work coil 10 is contained within a housing 26 of FIGS. 1 and 1A the composition of which depends on the circumstances and the objectives. For example, when heating the surface to temperatures in the lower ranges, e.g. below 185 degrees C., the work coil could be encased in a thermo-conductive, electrically-insulating material which is a composite of a synthetic resin, such as fiberglass or epoxy and a metallic powder, such as copper or aluminum. Such a work coil could generate up to 5 KW without requiring cooling. At higher temperatures and power outputs, 185–425 degrees C., cooling coils as discussed below could also be encased in the composite, in order to cope with the temperature limit of the resins. Housing 26 of FIGS. 1 & 1A is a composite of epoxy and aluminum powder.

The housing could be cage like, with the bottom and part of the sides closest to the surface being heated, covered with appropriate material so that cooling air supplied to the interior of the work coil (by tubing) could blow about the interior and out the open end, away from the surface. If there is enough space a small fan could be used. In the case of rapidly rotating rolls and a completely open cage, the "wind" from the rolls could keep the work coil within its temperature limits. Air cooling seems applicable in the 185 to 250 degree C. range. While water cooling is more efficient than air cooling, it may not be desirable in certain situations.

As is discussed above, there are various ways to keep the work coil relatively cool. The degree of cooling required also depends on the amount of heat radiation coming from the material being heated, and how much cooling comes from the boundary air layer surrounding a rotating roll or cylinder.

When a metallic tubing circulating cooling water is used for cooling it is advisable to use a simple tightly twisted loop rather than a coil configuration to avoid a voltage being induced in the cooling coil. This loop could be located in the space between the two legs of the core 20. Alternatively a coil of insulated copper tubing can be used to carry both the electric current as well as the cooling water, by replacing the Litz wire with the tubing. Isolation of the coil can be insured by supplying the tubing with water from a length of plastic tubing. Because of the size of the insulated tubing and other reasons this embodiment would have limited use.

As is discussed at line 10 of column 6 of the '514 patent any suitable voltage can be used for the power source. Common voltages used are 208V, 220V and 440V. With the present coil frequencies up to 50 KHz can be used. As is described in the '514 patent, power control can use an on-off method or time or frequency modulation. Further details as to the power generator and control circuit can be found at lines 14–30 of column 6 of the '514 patent. As is discussed at lines 57–68 of column 6 of the '514 patent, a direct current could also be used to generate the magnetic field, where the heating power is supplied by the motor driving the calender of a papermaking machine.

An induction heating power source is usually composed of a power line rectifier together with a high frequency inverter. The rectifier converts AC power into a DC voltage source and the inverter is used to create a high frequency current in the work coil. The circuit shown in FIG. 4 of the '514 patent can be used with the work coil 10.

As is evident from the above description, the attainment of the desired temperature depends largely on the methods of cooling (and the properties of any encasing material) of the work coil 10. For much higher temperatures (425–1000 degrees C. or more) it may be necessary to use iron laminated or special ferrite like material (e.g. FLUXTROL) for the core 20 as ferrite has a relatively low temperature limit.

Figure 2:
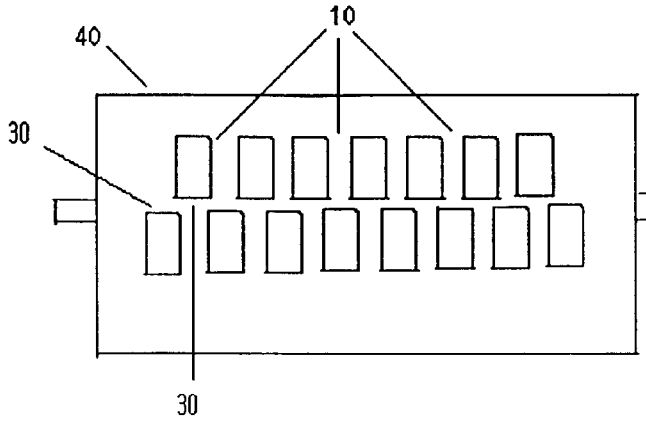
FIG. 2 is a view of the use of the work coils when a plurality of stationary coils are placed across a rotating roll.
Figure 2A:
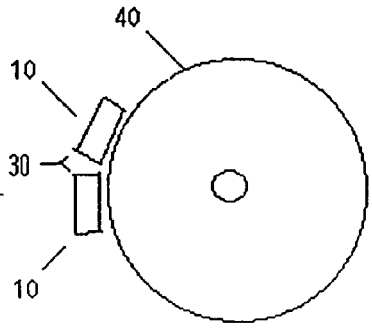
FIG. 2A is a end view of FIG. 2.

Referring now to FIGS. 2 and 2A, there is shown a typical application of the work coils 10 for a heating system. A plurality of work coils 10 (with their power source not shown) are placed in an alternating offset, side-by-side stationary relationship across a rotating calendering roll 40. The work coils 10 are closely spaced to the surface of the roll 40 as shown in FIG. 2A, and the spacing between alternate coils is such that the heating effect between the coils do not overly overlap each other but merely mate in a smooth manner. By such an arrangement an uninterrupted controlled temperature profile can be established across roll 40, using any desired control width. As is shown in FIG. 1 of the '514 Patent the support means for such an array is well known.

To accomplish the above described closeness of the coils and avoid interaction, it has been discovered that it may be necessary to add a layer of ferrite 50 (approximately the same width and height as that of the core 20), as close as possible to the windings, on at least one side of the work coil 10. This is shown in FIGS. 3 & 3A, which is a typical embodiment of a work coil 10 where the ends of the legs are not profiled nor are additional ferrite layers 23 and 23' attached.

Thus when coils 10 are used in an array as shown in FIGS. 2 & 2A, the side 30 with the ferrite layer 50 of each coil 10 is offset but adjacent to the next work coil. The ferrite layer 50 keeps the magnetic lines of flux within the confines of the work coil 10. To avoid confusion as to which side of each work coil 10 has the layer, it might be advisable to add the ferrite layer 50 to both sides of the work coil 10. In certain arrays, a layer may be placed on the face of the work coil e.g. when they are side by side. Other shielding methods can be used e.g. a metal shield disposed within the housing, covering the vulnerable sides, although this is not as efficient as the ferrite layers, which also act as flux concentrators.

Many other work coil arrays can be used depending on the objective. In the array 40 shown in FIGS. 2 & 2A it was desired to obtain the tightest control in a limited space.

In the application shown in FIGS. 2 and 2A, the work coils 10 are stationary. In another heating system (not shown), one or more work coils, spaced apart from each other in the longitudinal direction across the roll and supported by a traversing mechanism, oscillate close to and across the surface being heated.

Orientation of the work coil is optional, but for optimum use, its axis perpendicular to the face of U, should be oriented for:

(a) general use, such as soldering, de-freezing connections, etc., in the same direction that the coil is moving to heat the material;

(b) heating the surface of a substantially flat moving layer of ferromagnetic material, in the same direction as the transverse direction of the moving layer; and (c) heating the surface of a rotating roll or cylinder whose surface is made of ferromagnetic material, in the same direction as the longitudinal axis of the roll or cylinder.

The present invention may be used as is described in the '514 patent to control the roll pressing operation of a web material such as paper, plastic or metal. The present invention may also be used to control the wet pressing and drying of a web material as is described in U.S. Pat. No. 4,788,779 where a great deal of heat has to be applied over a short period of time. The present invention may also be used in other processes such as lamination, glazing, soldering, bonding or welding, melting of metals etc.

As is described in column 7 of the '514 patent, the heating, in certain applications, is controlled by a physical property (e.g. caliper of the web) being measured, which in turn is controlled by the heating in a closed loop fashion. Where such a property is not available, heat sensors may be provided to measure the temperature across the surface of the roll 40 in FIG. 2 herein. This temperature measurement is used to control the individual power sources which vary the excitation current in their respective work coils, thereby achieving the required temperature profile across the roll.

In certain applications, such as soldering and welding, it is desirable to concentrate the magnetic flux into a very narrow area of the material to be heated. This concentration of the flux can be accomplished by using a U core with legs having a fairly small cross-section and shaping the ends of the legs so that the edges that face each other, come to a very narrow somewhat pointed profile. With respect to the embodiment shown in FIG. 3A that would mean that the CW would be wide enough to carry the concentrated flux and could be in the order of 5 mm wide. In addition, the ends could also be given the profile shown in FIG. 1. Alternatively, this concentration of flux could be accomplished using separate ferrite layers attached to the ends as described for the embodiment shown in FIG. 1.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An induction heating device for heating electroconductive material to a desired temperature, said device having a heating end with an opening disposed proximate to the material during heating of the material, said device comprising:

an open core comprising U-shaped body of magnetic material having a pair of legs and a pair of edges located at ends of the legs, said edges being separated by space and being disposed at the opening in the heating end of the device;

coils of electrically conductive material wound separately on the legs of the U-shaped body, respectively, said coils for simultaneously receiving in parallel a current to excite each of said coils, said legs becoming the pole pieces of magnetic flux concentrator whenever said excitation current is passed through said coils in parallel to produce a variable magnetic field of very high flux density in the space between the two edges, facing each other, at the ends of the two poles, and closest to the material being heated; and wherein each of said coils is wound around each leg in a direction such that on excitation, when one leg becomes the N pole of said flux concentrator the other leg becomes the S pole of said concentrator, said legs alternating in polarity when said excitation current alternates in polarity, thereby forcing the magnetic flux to pass between the edges at the ends of the pole pieces, facing each other, and through said material to be heated.

2. The induction heating device of claim 1 wherein said open core is made of ferrite material having a very high magnetic permeability and each of said coils wound around said legs of said U-shaped body is Litz wire.

3. The induction heating device of claim 1 further comprising duplicates of said open core stacked face to face to provide thicker legs about which said coils are wound.

4. The induction device of claim 1 wherein said coils wound on said legs are coils of insulated copper tubing through which cooling water and said excitation current are passed to cool said device and generate said magnetic field.

5. The induction heating device of claim 1 further comprising separate substantially rectangular flat thin layers of ferrite attached to the ends of said legs, respectively, said ferrite layers including the edges and each having a length sufficient to cover the end of its respective leg and a width in the direction of an axis perpendicular to the face of the U-shaped body corresponding to the width of a desired control heating effect.

6. The induction heating device of claim 5 wherein said ferrite layers are attached to said ends of said legs so as to present an angled profile when viewed from the face of said U-shaped body.

7. The induction heating device of claim 1 further comprising a separate substantially rectangular flat thin side layer of ferrite having a height and width approximately the same as said core, said side layer being attached to the outer side of one of said legs as close as possible to said windings on said leg.

8. The induction heating device of claim 1 wherein said coils are wound on each of said legs such that the windings are concentrated at the ends of said legs, closest to the material being heated.

9. The induction heating device of claim 1 wherein said electroconductive material is mainly ferromagnetic material.

10. The induction heating device of claim 1 wherein each leg of the U-shaped body ends in a shape not conforming to an exterior shape of an apparatus to be heated by said induction heating device.

11. An induction heating device for heating electroconductive material to a desired temperature, said device having a heating end with an opening disposed proximate to the material during heating of the material, said device comprising:

an open core comprising a U-shaped body of magnetic material having a pair of legs and a pair of edges located at ends of the legs, said edges being separated by a space and being disposed at the opening in the heating end of the device;

coils of electrically conductive material wound separately on the legs of the U-shaped body, respectively, each leg ending in a shape not conforming to an exterior shape of an apparatus to be heated by said induction heating device, said legs becoming the pole pieces of a magnetic flux concentrator whenever an excitation is passed through said two coils in parallel to produce a variable magnetic field of very high flux density in the space between the two edges, facing each other, at the ends of the two poles, and closest to the material being heated; and wherein each of said coils is wound around each leg in a direction such that on excitation, when one leg becomes the N pole of said flux concentrator the other leg becomes the S pole of said concentrator, said legs alternating in polarity when said excitation current alternates in polarity, thereby forcing the magnetic flux to pass between the edges at the ends of the pole pieces, facing each other, and through said material to be heated.

12. The induction heating device of claim 11 further comprising duplicates of said open core stacked to face to provide thicker legs about which said coils are wound.

13. The induction device of claim 11 wherein said coils wound on said legs are coils of insulated copper tubing through which cooling water and said excitation current are passed to cool said device and generate said magnetic field.

14. The induction heating device of claim 11 further comprising a separate substantially rectangular flat thin layers of ferrite attached to ends of said legs, respectively, said ferrite layers including the edges and each having a length sufficient to cover the end of its respective leg and a width in the direction of an axis perpendicular to the face of the U-shaped body corresponding to the width of a desired control heating effect.

15. The induction heating device of claim 14 wherein said ferrite layers are attached to said ends of said legs so as to present an angled profile when viewed from the face of said U-shaped body.

16. The induction heating device of claim 11 further comprising a separate substantially rectangular flat thin side layer of ferrite having a height and width approximately the same as said core, said side layer being attached to the outer side of one of said legs as close as possible to said windings on said leg.

17. The induction heating device of claim 11 wherein said coils are wound on each of said legs such that the windings are concentrated at the ends of said legs, closest to the material being heated.

18. An induction heating device for heating electroconductive material to a desired temperature, said device having a heating end with an opening disposed proximate to the material during heating of the material, said device comprising:

an open core comprising a U-shaped body of magnetic material having a pair of legs and plates attached to ends of the legs, respectively, each of said plates having a width greater than the width of its corresponding leg, said plates having edges separated by a space and disposed at the open end of the device;

coils of electrically conductive material wound separately on the legs of the U-shaped body, respectively, each of said legs becoming the pole pieces of a magnetic flux concentrator whenever an excitation current is passed through said two coils in parallel to produce a variable magnetic field of very high flux density in the space between the two edges, facing each other, at the ends of the two poles, and closest to the material being heated; and wherein each of said coils wound around each leg in a direction such that on excitation, when one leg becomes the N pole of said flux concentrator the other leg becomes the S pole of said concentrator, said legs alternating in polarity when said excitation current alternates in polarity, thereby forcing the magnetic flux to pass between the edges at the ends of the pole pieces, facing each other, and through said material to be heated.

19. The induction heating device of claim 18 further comprising duplicates of said open core stacked face to face to provide thicker legs about which said coils are wound.

20. The induction device of claim 18 wherein said coils wound on said legs are coils of insulated copper tubing through which cooling water and said excitation current are passed to cool said device and generate said magnetic field.

21. The induction heating device of claim 18 wherein said plates are composed of ferrite and are attached to said ends of said legs so as to present an angled profile when viewed from the face of said U.

22. The induction heating device of claim 18 further comprising a separate substantially rectangular flat thin side layer of ferrite having a height and width approximately the same as said core, said side layer being attached to the outer side of one of said legs as close as possible to said windings on said leg.

23. The induction heating device of claim 18 wherein said coils are wound on said legs such that the windings are concentrated at the ends of said legs, closest to the material being heated.

24. The induction heating device of claim 18 wherein each leg of the U-shaped body ends in a shape not conforming to an exterior shape of an apparatus to be heated by said induction heating device.

25. The induction heating device of clam 1, further comprising a housing containing the open core and the coils, said housing being formed from a resin and metallic powder.

26. The induction heating device of claim 11, further comprising a housing containing the open core and the coils, said housing being formed from a resin and metallic powder.

27. The induction heating device of claim 18, further comprising a housing containing the open core and the coils, said housing being formed from a resin and metallic powder.

* * * * *